US009514675B2

(12) United States Patent
Kim

(10) Patent No.: US 9,514,675 B2
(45) Date of Patent: Dec. 6, 2016

(54) METHOD AND DEVICE FOR CONTROLLING POWER OF ACTIVE MATRIX ORGANIC LIGHT-EMITTING DIODE

(71) Applicant: Samsung Electronics Co., Ltd., Gyeonggi-do (KR)

(72) Inventor: Jong Hwan Kim, Seoul (KR)

(73) Assignee: Samsung Electronics Co., Ltd., Yeongtong-gu, Suwon-si, Gyeonggi-do (KR)

( * ) Notice: Subject to any disclaimer, the term of this patent is extended or adjusted under 35 U.S.C. 154(b) by 0 days.

(21) Appl. No.: 14/279,813

(22) Filed: May 16, 2014

(65) Prior Publication Data

US 2014/0247294 A1 Sep. 4, 2014

Related U.S. Application Data

(63) Continuation of application No. 12/638,275, filed on Dec. 15, 2009, now Pat. No. 8,730,271.

(30) Foreign Application Priority Data

Dec. 30, 2008 (KR) ..... 10-2008-0137034

(51) Int. Cl.

| | |
|---|---|
| ***G09G 5/00*** | (2006.01) |
| ***G09G 3/30*** | (2006.01) |
| ***G09G 3/32*** | (2016.01) |
| *G09G 5/10* | (2006.01) |

(52) U.S. Cl.

CPC ..... *G09G 3/3225* (2013.01); *G09G 5/10* (2013.01); *G09G 2320/0646* (2013.01); *G09G 2320/103* (2013.01); *G09G 2330/021* (2013.01); *G09G 2360/16* (2013.01)

(58) Field of Classification Search

CPC ..... G09G 5/02; G09G 2340/06; G09G 2320/0666; G09G 3/3406; G09G 5/10; G09G 2320/0626; G09G 2360/16; G09G 3/2003; G09G 3/3607; G09G 3/3648; G09G 2320/0242; G09G 3/3208; G09G 3/3225; G09G 2320/0233

See application file for complete search history.

(56) References Cited

U.S. PATENT DOCUMENTS

| | | | | |
|---|---|---|---|---|
| 7,397,452 | B2 | 7/2008 | Nakamura | |
| 8,134,549 | B2 | 3/2012 | Han et al. | |
| 2004/0135755 | A1* | 7/2004 | Hong | G09G 3/3648 345/89 |
| 2005/0052401 | A1 | 3/2005 | Lee | |
| 2005/0231449 | A1 | 10/2005 | Miyagawa | |
| 2006/0055335 | A1 | 3/2006 | Shingai et al. | |
| 2006/0262109 | A1 | 11/2006 | Park et al. | |

(Continued)

FOREIGN PATENT DOCUMENTS

| | | |
|---|---|---|
| CN | 101271208 A | 9/2008 |
| EP | 1 622 119 A1 | 2/2006 |

(Continued)

*Primary Examiner* — Lixi C Simpson
(74) *Attorney, Agent, or Firm* — Cha & Reiter, LLC

(57) ABSTRACT

A method and device for controlling power of an active matrix organic light-emitting diode are provided. The method for controlling power of an active matrix organic light-emitting diode includes: calculating a frame data rate, which is a ratio of a light emitting pixel quantity representing a specific color in an image data to be displayed; determining a luminance reducing amount mapped to the frame data rate; and controlling and displaying an entire luminance of an image according to the luminance reducing amount.

17 Claims, 3 Drawing Sheets

(56) References Cited

U.S. PATENT DOCUMENTS

| | | | | |
|---|---|---|---|---|
| 2006/0262111 | A1 | 11/2006 | Kerofsky | |
| 2007/0008297 | A1 | 1/2007 | Bassetti | |
| 2007/0115302 | A1* | 5/2007 | Huang | 345/690 |
| 2007/0229516 | A1* | 10/2007 | Sugimoto | 345/473 |
| 2008/0036729 | A1* | 2/2008 | Mukuda | 345/102 |
| 2008/0088548 | A1 | 4/2008 | Lee et al. | |
| 2008/0111778 | A1 | 5/2008 | Shen et al. | |
| 2008/0144112 | A1* | 6/2008 | Moon | 358/3.03 |
| 2008/0174700 | A1 | 7/2008 | Takaba | |
| 2008/0204475 | A1 | 8/2008 | Kim et al. | |
| 2008/0266236 | A1* | 10/2008 | Shen et al. | 345/102 |
| 2009/0002302 | A1* | 1/2009 | Koo et al. | 345/89 |
| 2009/0028460 | A1 | 1/2009 | Jung et al. | |
| 2010/0073276 | A1* | 3/2010 | Koike et al. | 345/102 |
| 2010/0073390 | A1* | 3/2010 | Myers | 345/581 |

FOREIGN PATENT DOCUMENTS

| | | | |
|---|---|---|---|
| EP | 1 962 272 | A1 | 8/2008 |
| JP | 2003-280589 | A | 10/2003 |
| JP | 2005-301095 | A | 10/2005 |
| JP | 2006-309134 | A | 11/2006 |
| JP | 2006-350173 | A | 12/2006 |
| JP | 2007-148064 | A | 6/2007 |
| JP | 2008-3590 | A | 1/2008 |
| JP | 2008-20769 | A | 1/2008 |
| JP | 2008-209885 | A | 9/2008 |
| KR | 10-0844775 | B1 | 7/2008 |

* cited by examiner

METHOD AND DEVICE FOR CONTROLLING POWER OF ACTIVE MATRIX ORGANIC LIGHT-EMITTING DIODE

CROSS REFERENCE TO RELATED APPLICATIONS

The present application is a Continuation of U.S. patent application Ser. No. 12/638,275 filed on Dec. 15, 2009, which claims the benefit of the earlier filing date, pursuant to 35 USC 119, to that Korean Patent Application No. 10-2008-0137034 filed in the Korean Intellectual Property Office on Dec. 30, 2008, the entire contents of which are incorporated herein by reference.

BACKGROUND

1. Field of the Invention

The present invention relates to light-emitting diode devices, and more particularly, to a method and device for controlling power of an active matrix organic light-emitting diode.

2. Description of the Related Art

A display device of a mobile terminal may be one of a liquid crystal display, field emission display, plasma display panel, and organic light emitting display.

The organic light emitting display of the display device of the mobile terminal uses an organic light emitting diode (hereinafter, an OLED) that generates light while coupling electrons and holes in an organic material layer when a current flows to a fluorescent or phosphorescent organic thin film. Such an OLED is classified into a passive matrix organic light-emitting diode (a PMOLED) and an active matrix organic light-emitting diode (an AMOLED). The PMOLED uses a line driving method in which an entire line of devices is driven to emit light at one time. The AMOLED uses a method in which each light emitting element is individually driven to emit light. The light emitting element (i.e., pixel) includes a red (R) OLED element for emitting red color light, green (G) OLED element for emitting green color light, and blue (B) OLED element for emitting blue color light. The light emitting element can express a desired color by mixing light of the three colors from the corresponding light emitting elements.

The AMOLED is widely used in various fields such as a mobile communication terminal, personal digital assistant (PDA), and Moving Picture Experts Group layer-3 (MP3) player due to various advantages such as excellent color reproducibility, thickness, quick response speed, large viewing angle, and high contrast ratio. However, in order to display a bright color, the AMOLED drives all R, G, and B OLEDS and thus when displaying an image (for example, an image including a large quantity of white color) in which an occupying ratio of a bright color is high, power consumption quickly increases.

SUMMARY

The present invention provides a method and device for controlling power of an AMOLED that can reduce power consumption by reducing an entire luminance when displaying an image in which an occupying ratio of a bright color is high.

In accordance with an aspect of the present invention, a power control device of an AMOLED includes: a display unit for displaying image data and formed with the AMOLED; and a controller for calculating, when displaying the image data, a frame data rate, which is a ratio of a light emitting pixel quantity representing a specific color in the image data, determining a luminance of the image data according to the frame data rate, and providing the luminance of the image data to the display unit.

In accordance with another aspect of the present invention, a method for controlling power of an AMOLED includes: calculating a frame data rate, which is a ratio of a light emitting pixel quantity representing a specific color in the image data to be displayed; determining a luminance reducing amount mapped to the frame data rate; and controlling and displaying the entire luminance of an image according to the luminance reducing amount.

BRIEF DESCRIPTION OF THE DRAWINGS

The above features and advantages of the present invention will be more apparent from the following detailed description in conjunction with the accompanying drawings, in which.

DETAILED DESCRIPTION

Figure 1:
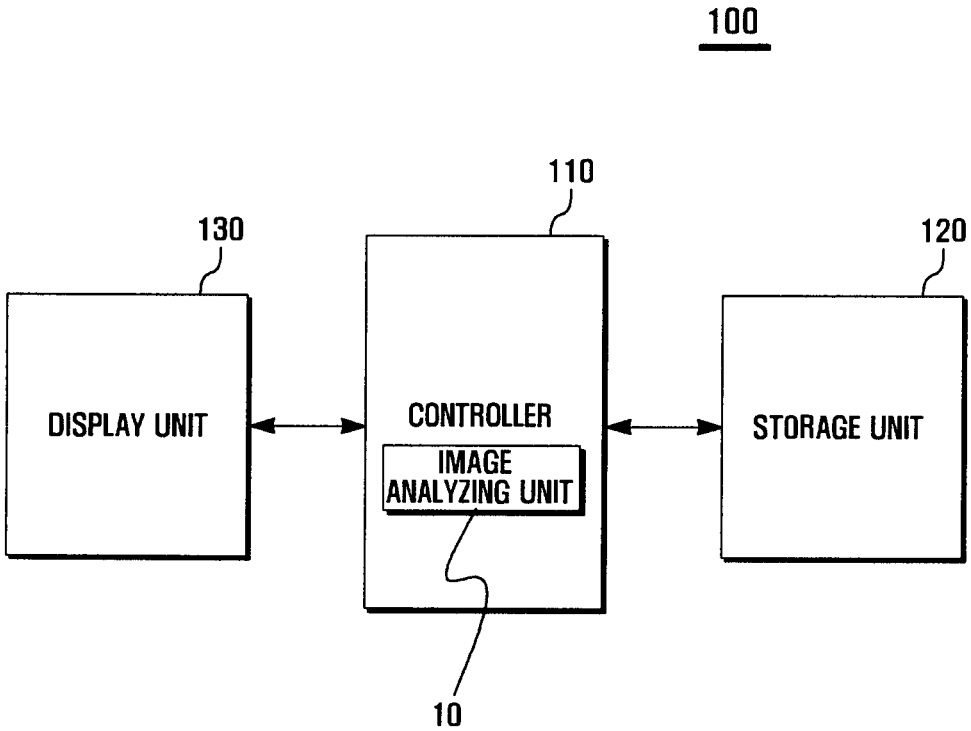
FIG. 1 is a block diagram illustrating a configuration of a mobile terminal according to an exemplary embodiment of the present invention.

Exemplary embodiments of the present invention are described in detail with reference to the accompanying drawings. The same reference numbers are used throughout the drawings to refer to the same or like parts. Detailed descriptions of well-known functions and structures incorporated herein may be omitted to avoid obscuring the subject matter of the present invention.

While the present invention may be embodied in many different forms, specific embodiments of the present invention are shown in the drawings and are described herein in detail, with the understanding that the present disclosure is to be considered as an exemplification of the principles of the invention and is not intended to limit the invention to the specific embodiments illustrated.

In the following description, a mobile terminal according to the present exemplary embodiment may be an information and communication device or a multimedia device such as a mobile phone, PDA, smart phone, International Mobile Telecommunication 2000 (IMT-2000) terminal, code division multiple access (CDMA) terminal, wideband code division multiple access (WCDMA) terminal, Global System for Mobile Communication (GSM) terminal, general packet radio service (GPRS) terminal, universal mobile telecommunication service (UMTS) terminal, digital broadcasting terminal, laptop computer, television, large format display (LFD), navigation terminal, and applications thereof.

A "frame data rate" is presented as being an occupying ratio of a specific color (for example, a white color) in an image data of a frame.

Figure 2:
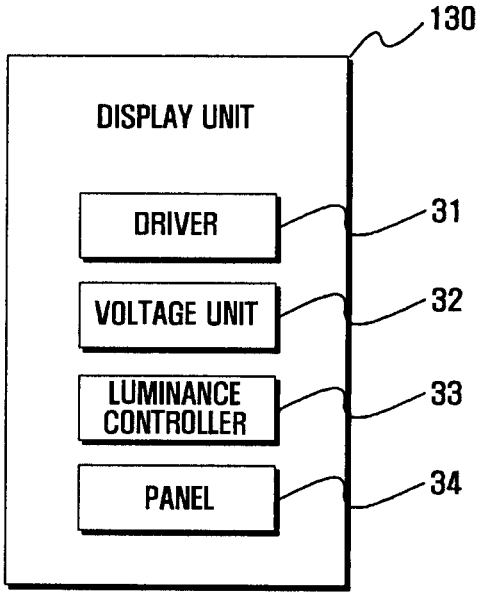
FIG. 2 is a block diagram illustrating a display unit in the mobile terminal of FIG. 1.

FIG. 1 is a block diagram illustrating a configuration of a mobile terminal according to an exemplary embodiment of the present invention, and FIG. 2 is a block diagram illustrating a display unit in the mobile terminal of FIG. 1.

Referring to FIGS. 1 and 2, a mobile terminal 100 includes a controller 110, storage unit 120, and display unit 130.

The display unit 130 displays various menu screens of the mobile terminal 100, data input by a user, function setting information, and various information provided to the user. When the display unit 130 is formed as a touch screen, the display unit 130 can be operated as an input unit (not shown). Particularly, in the present exemplary embodiment, the display unit 130 is formed as an AMOLED. The display unit 130 includes a driver 31, a voltage unit 32, a luminance controller 33, and a panel 34 (see FIG. 2).

The panel 34 includes a polarizer, upper glass, lower glass, and an organic material layer positioned between the upper glass and the lower glass (not shown). The organic material layer is divided into a plurality of unit areas by a plurality of gate lines and a plurality of data lines intersecting each other. Light emitting pixels are mounted in each of the plurality of unit areas. Each light emitting pixel includes red (R), green (G), Blue (B) OLEDS. Particularly, in the present exemplary embodiment, the panel 34 controls an amount of light emitted according to the frame data rate by the control of the luminance controller 33. In other words, in the present exemplary embodiment, when the panel 34 displays an image including a large amount of bright color under the control of the luminance controller 33, the amount of light emitted can be reduced.

A light emitting principle of the OLED light emitting pixel is well known to a person of ordinary skill in the art and therefore a detailed description thereof is omitted.

The driver 31 drives the light emitting pixels on the panel 34 according to image data received from the controller 110 (FIG. 1). For this, the driver 31 includes a data driver, gate driver, and timing controller (not shown).

The gate driver can sequentially enable a plurality of gate lines on the panel 34 in each frame (period of a vertical synchronizing signal) during a predetermined period (for example, a period of a horizontal synchronizing signal). For this, the gate driver can operate according to a gate control signal including a clock signal having a gate start pulse and a period of the horizontal synchronizing signal (not shown).

Whenever one of a plurality of gate lines is enabled (i.e. in each period of a horizontal synchronizing signal), the data driver supplies an image data signal of a line to a plurality of data lines on the panel 34. For this, the data driver inputs image data to the plurality of data lines in a stream form according to a data control signal.

The timing controller (not shown) controls a driving time of the gate driver and the data driver. That is, the timing controller generates a gate control signal and a data control signal according to a sync signal. Further, the timing controller receives image data of a frame unit from the controller 110, aligns the image data on a data line basis, and supplies the image data to the data driver.

The voltage unit 32 generates a driving voltage necessary for the light emitting pixels on the panel 34. The driving voltage is commonly supplied to the light emitting pixels on the panel 34. In this case, light emitting pixels on the panel 34 driven by a driving voltage of the voltage unit 32 can be selectively enabled in a line by line manner by the gate driver. The enabled light emit pixels charge to a predetermined voltage according to image data supplied via the data line from the data driver and emit light to correspond to the charged voltage. Thus, the light emitting pixel outputs a color applied to the pixel elements to display an image.

The luminance controller 33 controls luminance of a light emitting pixel on the panel 34 under the control of the controller 110. For this, the luminance controller 33 controls a voltage or a current supplied to a light emitting pixel on the panel 34. Particularly, in the present exemplary embodiment, the luminance controller 33 receives a luminance control signal from the controller 110 according to a luminance reducing amount mapped to the frame data rate and controls the entire luminance of the display unit 130 to correspond to the luminance control signal. That is, when a bright image having a large power consumption is displayed, the luminance controller 33 reduces a voltage or a current supplied to the light emitting pixel according to the luminance control signal.

The storage unit 120 stores a program necessary for a function operation and user data according to the present exemplary embodiment. The storage unit 120 includes a program area and a data area.

The program area stores a program for controlling general operations of the mobile terminal 100, an operating system for booting the mobile terminal 100, and an application program necessary for other option functions, for example, a camera function, digital broadcasting reception function, image or moving picture reproducing function, and music reproducing function of the mobile terminal 100. Particularly, in the present exemplary embodiment, the program area includes a program for controlling the entire luminance of the display unit 130 according to the frame data rate.

The data area is an area for storing data generated according to use of the mobile terminal 100 and stores information corresponding to a phonebook, audio data, related content, or other user data. Particularly, in the present exemplary embodiment, the data area stores a luminance reducing amount according to the frame data rate as is shown in Table 1.

TABLE 1

| Frame data rate | Luminance reducing amount |
|---|---|
| 0 to less than 50% (dark screen) | None |
| 50 to less than 70% (intermediate brightness screen) | Reduce one step |
| 70 to less than 90% (bright screen) | Reduce two steps |

In Table 1, in the present exemplary embodiment, an image is divided into three steps according to a frame data rate of the image data, and a luminance reducing (adjustment) amount changes according to each step. That is, in an image in which an occupying ratio of a bright color is high, a luminance reducing (adjustment) amount increases in order to reduce the current consumption of an image in which an occupying ratio of a bright color is high. For example, when the frame data rate is 70% to less than 90%, the luminance is set to a default reduction of two steps, and when the frame data rate is 50% to less than 70%, the luminance is set to a default reduction of one step. As would be recognized, the luminance reducing amount may be changed according to a designer's intention.

The present invention is not limited to values of Table 1. That is, in Table 1, a luminance reducing amount according to the frame data rate provides reduction in the luminance in a step-wise manner, however the luminance reducing amount may be a specific value mapped to the frame data rate. For example, when the frame data rate is 50 to less than 70%, the luminance reduction amount (adjustment factor) may be set to a default amount of 10% of the luminance and when the frame data rate is 70 to less than 90%, the luminance reduction amount may be set to a default amount of 30% of luminance. The luminance reducing amount can be optimized by a designer through experimentation. This is because a current consumption amount can change according to a size of the panel 34 or a driving voltage. Further, the luminance reducing amount is based on a bright color, and when the luminance reducing amount is based on a dark color, the luminance reducing amount can change. Further, in Table 1, an image according to the frame data rate is divided into three steps, however the image may be subdivided or reduced in a larger number (or finite step size) according to a designer's requirements.

The controller 110 controls general operations of the mobile terminal 100 and a signal flow between units of the mobile terminal 100 and performs a data processing function. Particularly, in the present exemplary embodiment, the controller 110 includes an image analyzing unit 10 (see FIG. 1).

The image analyzing unit 10 determines image data and calculates a frame data rate, which is an occupying ratio of a bright color included in the image data. For this, the image analyzing unit 10 counts R, G, B bits representing color information of the light emitting pixel. In more detail, a light emitting pixel includes R, G, B light-emitting diodes, and the R, G, B light-emitting diodes each have a value of 6 bits and can adjust brightness accordingly. That is, a pixel can be expressed with 18 bits (driving word). For example, when a driving word of the light emitting pixel is '0', i.e. "000000000000000000", the pixel is displayed with a black color, and when a driving word is '1', i.e. "111111111111111111", the pixel is displayed with a white color. When each of the bits of the driving word is a '1', i.e. when a white color is displayed, the largest amount of current is consumed. Therefore, the image analyzing unit 10 calculates a frame data rate by counting the light emitting pixel quantity representing a white color of the entire pixel. That is, as a ratio of a light emitting pixel representing a white color increases, and an image having large current consumption is displayed, the display is controlled to lower a voltage or a current value input to the light emitting pixel.

In this case, the image analyzing unit 10 determines a part of upper level bits (for example, upper level 3 bits) of each of R, G, and B light-emitting diodes and calculates a frame data rate. For example, by counting the quantity of light emitting pixels in which upper level 3 bits is 1, i.e. the entire driving word expressed as "111*111*111*", the frame data rate may be calculated. The reason why to determine only a part of upper level bits is that lower level bits represent a minute color change and do not have a great difference in a current consumption aspect. Alternatively, the image analyzing unit 10** determines only a part of upper level bits (for example, upper level 9 bits) in the entire driving word and calculates a frame data rate. In the present exemplary embodiment, the frame data rate is divided into 3 steps, however the present invention is not limited thereto. That is, in the present invention, the frame data rate can be set to a plurality of steps according to a designer's requirements, without altering the scope of the invention. Further, the frame data rate is calculated by counting a light emitting pixel quantity representing the white color, however the present invention is not limited thereto. For example, the frame data rate can be calculated based on a specific color according to a black color or a designer's intention. When an image is a moving picture, the frame data rate is periodically calculated, and when an image is a still picture, if the image is converted to a different image, the frame data rate is calculated.

The controller 110 controls luminance of image data according to the frame data rate. In other words, when the frame data rate is large (for example, more than 50%), the controller 110 determines that the display unit 130 consumes a large amount of current and reduces luminance, i.e. brightness of the display unit 130. For this, the controller 110 transmits a luminance control signal to the luminance controller 33.

In the present exemplary embodiment, the image analyzing unit 10 calculates a frame data rate by determining an entire image data corresponding to a frame, however the present invention is not limited thereto. That is, the image analyzing unit 10 calculates the frame data rate by determining some of image data corresponding to a frame, thereby preventing an overload of the system from being generated.

As described above, in the present invention, in a mobile terminal using an AMOLED, when displaying an image in which an occupying ratio of a bright color is high, power consumption can be reduced by reducing entire luminance. Furthermore, a battery use time period of a mobile terminal can be increased as less power is being consumed.

Further, although not shown, the mobile terminal 100 may include constituent elements having an additional function, such as a camera module for photographing an image or a moving picture, broadcasting reception module for receiving digital broadcasting, audio signal output device such as a speaker, audio signal input device such as a microphone, and digital sound source reproducing module such as an MP3 module. Such constituent elements are variously added according to a convergence trend of digital appliances and all constituent elements cannot be listed, and constituent elements identical to or corresponding to the above constituent elements can be further included in the mobile terminal 100 according to the present exemplary embodiment.

Hereinafter, a method of controlling power of an AMOLED is described.

Figure 3:
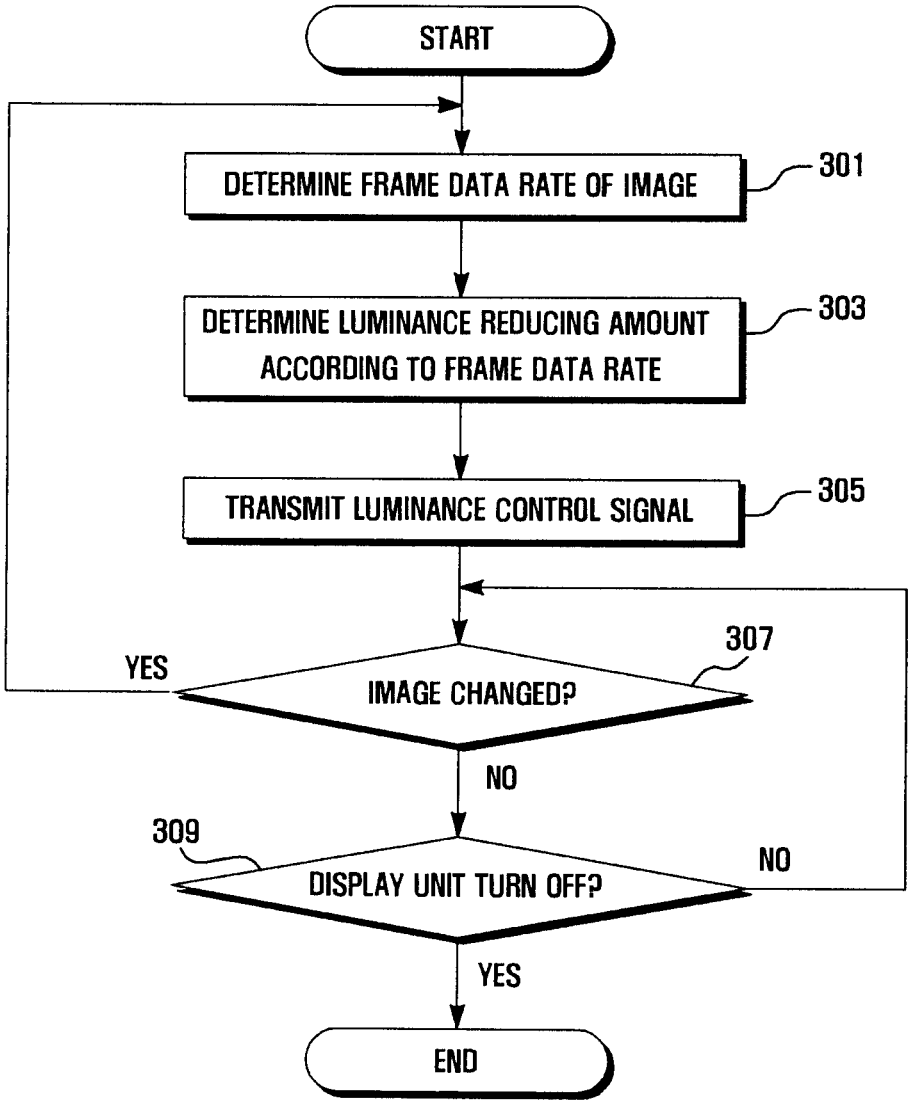
FIG. 3 is a flowchart illustrating a method of controlling power of an AMOLED according to an exemplary embodiment of the present invention.

FIG. 3 is a flowchart illustrating a method of controlling power of an AMOLED according to another exemplary embodiment of the present invention.

Referring to FIGS. 1 to 3, when an image (including a still picture and a moving picture) output event occurs, the controller 110 determines a frame data rate of an image to be output (301). The frame data rate is an occupying ratio of a bright color included in the image data. The frame data rate can be calculated by counting RGB bits representing color information of a light emitting pixel. A method of calculating the frame data rate as previously described may include counting a number of high order bits in each color in a pixel.

The controller 110 determines a luminance reducing amount according to the frame data rate (303). For this, the storage unit 120 stores a luminance reducing amount according to the frame data rate in a table form. The luminance reducing amount is set to provide a step wise decrease of the luminance value or may further implement a piece-wise linear reduction by determining reduction of the luminance as a percentage of the luminance value, wherein the reduction percentage is different for different range or may be set to a specific value.

The controller 110 transmits a luminance control signal according to the luminance reducing amount to the luminance controller 33 (305). The luminance controller 33, having received the luminance control signal controls the entire luminance of the display unit 130 by adjusting an output current or voltage of the driver 31. For example, when the frame data rate is 80%, the controller 110 transmits a luminance control signal for reducing the luminance by two steps according to Table 1 to the luminance controller 33. The luminance reducing amount can be optimized by a designer through experimentation. This is because a current consuming amount changes according to a size of the panel 34 or a driving voltage.

The luminance controller 33, having received the luminance control signal reduces the entire luminance of the display unit 130 by controlling an output current or voltage of the driver 31.

The controller 110 determines whether an image changes (307). If an image changes, the process returns to step 301. If an image does not change, the controller 110 determines whether the display unit 130 is turned off (309).

If the display unit 130 is not turned off, the process returns to step 307. If the display unit 130 is turned off, the controller 110 terminates the power control process.

The above-described methods according to the present invention can be realized in hardware or via the execution of software or computer code that can be stored in a recording medium such as a CD ROM, an RAM, a floppy disk, a hard disk, or a magneto-optical disk or downloaded over a network, so that the methods described herein can be executed by such software using a general purpose computer, or a special processor or in programmable or dedicated hardware, such as an ASIC or FPGA. As would be understood in the art, the computer, the processor or the programmable hardware include memory components, e.g., RAM, ROM, Flash, etc. that may store or receive software or computer code that when accessed and executed by the computer, processor or hardware implement the processing methods described herein. As would be recognized by those skilled in the art, when a general purpose computer is loaded with, or accesses, software or code for implementing the processing shown herein, the general purpose computer is transformed into a special purpose computer that may at least perform the processing shown herein.

As described above, the present invention can be applied to both a still picture and a moving picture. When a moving picture is output, a load can be applied to a system to control luminance by determining a frame data rate on a frame basis. Therefore, in the present invention, when a moving picture is output, by periodically determining the frame data rate, luminance of the display unit 130 is controlled.

In the present exemplary embodiment, luminance is controlled by calculating an occupying ratio of a bright color (for example, a white color), however the present invention is not limited thereto. That is, in the present invention, by determining an occupying ratio of a specific color according to a designer's intention, luminance of the display unit 130 is controlled.

As described above, in a method and device for controlling power of an AMOLED according to the present invention, when an image in which an occupying ratio of a bright color is high is displayed, power consumption can be reduced and thus a battery use time period of a mobile terminal can be extended.

Although exemplary embodiments of the present invention have been described in detail hereinabove, it should be clearly understood that many variations and modifications of the basic inventive concepts herein described, which may appear to those skilled in the art, will still fall within the spirit and scope of the exemplary embodiments of the present invention as defined in the appended claims. For example, although it has been described that the controller 110 determines a reduction factor that is transmitted to the display (step 305) and the display performs the reduction, it would be recognized that the controller may determine a reduction factor and alter the luminance value to be output. The altered luminance value may then be provided to the display and the display outputs the image based on the altered luminance value. This is advantageous as it allows for the incorporation of the present invention into existing devices.

What is claimed is:

1. A method comprising:

obtaining RGB color information of a plurality of pixels forming an image to be displayed via a display operatively coupled with an electronic device;

checking, based at least in part on a subset of the RGB color information of the plurality of pixels, whether a color of each pixel of the plurality of pixels falls within a specified range of colors;

calculating an amount of the image having the color corresponding to the specified range of colors;

determining a luminance to be used for the image based at least in part on the amount; and displaying the image according to the determined luminance via the display, the displaying including adjusting a voltage to be supplied to one or more pixels of the plurality of pixels according to the determined luminance.

2. The method of claim 1, wherein the display comprises an active matrix organic light emitting diode (AMOLED).

3. The method of claim 1, wherein the obtaining comprises:

obtaining the RGB color information representing at least one of red, green, or blue from at least one portion of the image.

4. The method of claim 1, wherein the calculating comprises:

analyzing one or more specified binary digits from a plurality of binary digits associated with the RGB color information.

5. The method of claim 4, wherein the analyzing comprises:

determining whether one or more upper level binary digits among the plurality of binary digits are 1.

6. The method of claim 1, wherein the calculating comprises:

periodically calculating the amount based at least in part on a determination that the image corresponds to a moving picture.

7. The method of claim 1, wherein the specified range of colors comprise white, and wherein the determining comprises:

determining the luminance as having a reduced level as compared a level of an original luminance of the image, based at least in part on a determination that the amount of the image corresponding to white is above a specified value.

8. The method of claim 1, wherein the determining comprises:

determining the luminance based on at least one of a size or driving voltage of the display.

9. An apparatus comprising:

a display; and a processor-implemented controller operatively coupled with the display, the processor-implemented controller configured to:

obtain RGB color information of a plurality of pixels forming an image to be displayed via the display;

check, based at least in part on the RGB color information, whether a color of each pixel of the plurality of pixels falls within a specified range of colors;

calculate a ratio of the image having the color corresponding to the specific range of colors;

determine a luminance corresponding to the image based at least in part on the ratio; and display the image according to the determined luminance via the display, the displaying including adjusting a voltage to be supplied to one or more pixels of the plurality of pixels according to the determined luminance.

10. The apparatus of claim 9, wherein the display comprises an active matrix organic light emitting diode (AMOLED).

11. The apparatus of claim 9, wherein the processor-implemented controller is configured to:

obtain the RGB color information representing at least one of red, green, or blue from at least one portion of the image.

12. The apparatus of claim 9, wherein the processor-implemented controller is configured to:

analyze one or more specified binary digits from a plurality of binary digits associated with the RGB color information.

13. The apparatus of claim 9, wherein the processor-implemented controller is configured to:

periodically calculate the ratio based at least in part on a determination that the image corresponds to a moving picture.

14. The apparatus of claim 9, wherein the specified range of colors comprises white and wherein the processor-implemented controller is configured to:

determine the luminance as having a reduced level as compared a level of an original luminance of the image, based at least in part on a determination that the ratio of the image corresponding to white is above a specified value.

15. The apparatus of claim 9, wherein the processor-implemented controller is configured to:

determine the luminance based on at least one of a size or driving voltage of the display.

16. A non-transitory machine-readable storage device storing instructions that, when executed by one or more processors, cause the one or more processors to perform operations comprising:

obtaining RGB color information of a plurality of pixels forming an image to be displayed via a display operatively coupled with an electronic device;

checking, based at least in part on a subset of the RGB color information of each of the plurality of pixels, whether a color of each of the plurality of pixels falls within a specified range of colors;

calculating a ratio of the image having the color corresponding to the specific range of colors;

determining a luminance corresponding to the image based at least in part on the ratio; and displaying the image according to the determined luminance via the display, the displaying including adjusting a voltage to be supplied to one or more pixels of the plurality of pixels according to the determined luminance.

17. The non-transitory machine-readable storage device of claim 16, wherein the specified range of colors comprise black.

* * * * *